US006398527B1

(12) United States Patent
Gram et al.

(10) Patent No.: US 6,398,527 B1
(45) Date of Patent: Jun. 4, 2002

(54) RECIPROCATING MOTOR WITH UNI-DIRECTIONAL FLUID FLOW

(75) Inventors: Anker Gram, Vancouver; Mihai Ursan, Burnaby, both of (CA)

(73) Assignee: Westport Research Inc., Vancouver (CA)

( * ) Notice: Subject to any disclaimer, the term of this patent is extended or adjusted under 35 U.S.C. 154(b) by 0 days.

(21) Appl. No.: 09/642,850

(22) Filed: Aug. 21, 2000

(51) Int. Cl.[7] ..... F04B 15/08; F04B 17/00; F01L 15/12

(52) U.S. Cl. ..... 417/901; 417/398; 417/403; 417/547; 91/224; 91/229

(58) Field of Search ..... 417/901, 398, 417/403, 545, 547, 552; 91/224, 229

(56) References Cited

U.S. PATENT DOCUMENTS

| | | | | | |
|---|---|---|---|---|---|
| 3,250,073 | A | | 5/1966 | Ellis, Jr. | 60/52 |
| 3,654,834 | A | | 4/1972 | Sifri et al. | 91/399 |
| 3,771,421 | A | * | 11/1973 | Scheffer | 91/277 |
| 4,458,579 | A | | 7/1984 | Rasmussen | 91/224 |
| 4,478,129 | A | | 10/1984 | Hannes et al. | 91/1 |
| 4,729,283 | A | * | 3/1988 | Hillier | 91/189 R |
| 4,825,752 | A | * | 5/1989 | Kiffmeyer | 91/422 |
| 5,188,014 | A | | 2/1993 | Simson | 91/10 |
| 5,203,251 | A | | 4/1993 | Karlberg | 91/224 |
| 5,341,723 | A | | 8/1994 | Hung | 91/224 |
| 5,425,305 | A | | 6/1995 | Mauritz | 92/181 |
| 5,787,940 | A | * | 8/1998 | Bonn et al. | 141/18 |
| 6,203,696 | B1 | * | 3/2001 | Pearson | 210/98 |

* cited by examiner

*Primary Examiner*—Charles G. Freay
*Assistant Examiner*—Michael K. Gray
(74) *Attorney, Agent, or Firm*—McAndrews, Held & Malloy, Ltd.

(57) ABSTRACT

A double-acting reciprocating motor with uni-directional fluid flow path comprises a piston disposed within a cylinder. A first chamber is defined by the cylinder space between the piston and a cylinder base. A second chamber is defined by the cylinder space between the piston and a cylinder head. Fluid is introduced into the motor through an inlet port and into the first chamber. A pass-through valve controls the flow of fluid from the first chamber to the second chamber. An outlet valve regulates the draining of fluid from the second chamber through an outlet port. The outlet port and the inlet port are associated with opposite ends of the motor. Differential fluid pressure urges the piston towards the cylinder head when the pass-through valve is closed and the outlet valve is open. The piston surface facing the second chamber is larger than the piston surface facing the first chamber, so the piston moves towards the cylinder base when the pass-through valve is open and the outlet valve is closed.

15 Claims, 5 Drawing Sheets

RECIPROCATING MOTOR WITH UNI-DIRECTIONAL FLUID FLOW

FIELD OF THE INVENTION

The present invention relates generally to a reciprocating motor with a uni-directional fluid flow path. The present device may be employed to convert fluid energy into useful mechanical work for any machine, such as a reciprocating piston pump. The present device is particularly advantageous for applications such as cryogenic pumps where the continuous uni-directional flow of fluid reduces the effect of heat transfer between the fluid within the reciprocating motor and the cryogenic apparatus.

BACKGROUND OF THE INVENTION

Conventional double-acting reciprocating motors use differential fluid pressure applied to a piston to cause reciprocating movement of the piston within a motor cylinder. Chambers on either side of the piston are equipped with respective fluid inlets and outlets that are controlled by external valves.

The piston moves to expand the volume of a first chamber by opening the inlet valve and closing the outlet valve associated with the first chamber while closing the inlet valve and opening the outlet valve associated with the second chamber on the opposite side of the piston. High-pressure fluid enters the first chamber through the open inlet valve while fluid is drained from the second chamber through the open outlet valve.

To move the piston in the opposite direction, the valve settings are reversed so that high-pressure fluid fills the second chamber and fluid is drained from the first chamber.

This type of reciprocating motor is known as a "double-acting" motor because fluid pressure is employed to move the piston in both directions and the piston rod extending from the reciprocating motor can perform mechanical work when traveling in both directions. A double-acting reciprocating motor is needed to drive a double-acting cryogenic pump that is designed to compress a cryogen with each piston stroke. That is, the pump piston compresses cryogen in both directions.

U.S. Pat. No. 4,458,579 (the '579 patent) discloses a motor for actuating a downhole pump in an oil well. The motor employs fluid pressure to raise the piston. At the top of the piston stroke a valve opens to allow the fluid to flow through the piston. The '579 patent discloses a motor with uni-directional fluid flow, but the motor is a single-acting motor that relies upon the force of gravity for downward movement of the piston. The motor has no valve at the fluid outlet for allowing fluid pressure to build in the cylinder space above the piston during the down-stroke.

U.S. Pat. No. 5,341,723 (the '723 patent) discloses a reciprocating air motor with a uni-directional air flow through the motor cylinder. The '723 patent discloses an internal venting arrangement whereby at the end of the piston stroke a groove in the cylinder wall allows the pressurized air to enter an internal chamber within the piston to open a valve to vent the pressurized air through the piston. However, like the '579 patent, the '723 patent does not disclose a double-acting reciprocating motor in that the pressurized air that passes through the piston is simply vented and a spring is employed to push the piston back to the starting position.

U.S. Pat. No. 5,203,251 (the '251 patent) discloses an air motor that has an air inlet and outlet on the same side of the piston. The air exits the motor through a bore formed in the piston rod. This arrangement may be suitable for air motors where the air is typically vented after exiting the motor. However, removing the fluid through the piston rod results in a more complicated arrangement in a closed loop system, which is typically the case when the fluid is a hydraulic oil or other liquid. When a high pressure fluid is employed, for example, for applications such as driving cryogenic pumps, an essentially incompressible liquid is typically employed instead of a gaseous fluid, such as air. Discharging the air through the piston rod, as disclosed by the '251 patent, also increases the time that the fluid is within the motor assembly and directs the fluid back to the same side as the inlet before the fluid is ultimately recovered in a closed-loop system. If this arrangement is employed for driving a cryogenic pump, the fluid would be directed back to the "cold" side before exiting the motor.

For cryogenic applications, the fluid is typically a liquid such as a hydraulic oil that is virtually incompressible and that also helps to lubricate the piston and cylinder. A particular problem with known double-acting reciprocating motors, which are employed to drive cryogenic pumps, is that there is a potential for the liquid within the motor cylinder nearest the cryogenic pump to become frozen. The problem is exacerbated if the same liquid is repeatedly returned to the "cold" side of the reciprocating motor without being directed back to the fluid reservoir or to the "warm" side of the motor that is further from the cryogenic pump. Thermal insulation is typically provided to shield the liquid from the cooling effect of the cryogenic pump. However, thermal insulation interposed between the cryogenic pump and the reciprocating motor adds to the weight, bulk and overall length of the pump and motor assembly. Furthermore, it is difficult to completely eliminate heat transfer because the piston rod assembly acts as a thermal conductor between the reciprocating motor and the cryogenic apparatus.

If actuation liquid is cooled so that it freezes within the reciprocating motor cylinder, severe damage may be caused to the motor and/or piston rod.

SUMMARY OF THE INVENTION

An objective of the present device is to provide a differential pressure, reciprocating motor with a uni-directional fluid flow path for applications that employ a double-acting motor. A particularly suitable application is for driving a cryogenic pump because the uni-directional flow path helps to reduce the effects of heat transfer between the cryogenic pump and the reciprocating motor. With a uni-directional flow path, the fluid flows through the reciprocating motor in one direction, flowing for example, from a high pressure fluid supply to the piston cylinder on a first side of the motor piston, then to a second side of the motor piston (opposite to the first side). The fluid is finally drained from the second side of the motor piston and returned to a reservoir.

A double-acting reciprocating motor with a uni-directional flow path is provided that comprises:

- a housing having a hollow cylinder disposed between a cylinder head and a cylinder base;
- a piston disposed within the cylinder between the cylinder head and cylinder base, the piston having a first pressure surface area and a second pressure surface area opposite to and larger than the first pressure surface area;
- a piston rod operatively associated with the piston and extending from the piston through the cylinder base;

a fluid inlet for directing fluid to a first chamber within the cylinder associated with the first surface area;

a fluid outlet for draining fluid from a second chamber within the cylinder associated with the second surface area;

a fluid passageway disposed within the piston, the fluid passageway fluidly connecting the first chamber to the second chamber;

a pass-through valve for selectively opening and closing the fluid passageway; and an outlet valve that is openable for draining fluid from the outlet when the pass-through valve is in the closed position.

In a preferred embodiment the fluid is a liquid and the reciprocating motor is for driving a double-acting cryogenic pump.

In one embodiment the pass-through valve comprises a movable plunger disposed within a bore formed in the body of the pass-through valve, wherein:

the bore has a longitudinal axis that is parallel to the longitudinal axis of the cylinder;

the plunger is movable to reciprocate within the bore; and the pass-through valve is actuated to switch between open and closed positions by an end of the plunger contacting a surface of the housing when the piston approaches one of the cylinder base and the cylinder head.

The outlet valve may comprise, for example, a plunger movable within a bore provided in the outlet valve; the plunger comprises a sealing surface that may be urged against a valve seat to close the outlet valve and lifted away from the seat to open the outlet valve. The plunger may further comprise a valve stem attached thereto for actuating the outlet valve. The outlet valve is automatically actuated by contact between the piston and the valve stem when the piston approaches one of the cylinder head and the cylinder base.

One end of the stem attached to the outlet valve plunger may be disposed within a well formed within the piston. In such an arrangement, the piston further comprises an actuating plate that contacts an enlarged end portion of the valve stem to lift the plunger from the valve seat when the piston approaches the cylinder base. The plunger sealing surface may be urged against the valve seat by the piston contacting the valve stem or the plunger. For example, as the piston approaches the cylinder head, the piston may contact the valve stem or plunger directly and push the plunger into the seated position. In another arrangement, as the piston approaches the cylinder head, the bottom of the well may contact the end of the valve stem disposed within the well and thus urge the plunger into the seated position.

In another preferred embodiment, the pass-through valve and the outlet valve are combined in an integrated valve assembly. For example, an integrated valve assembly may comprise:

a tubular valve body associated in fixed relationship with the cylinder head;

a tubular plunger disposed within the tubular valve body with a closed end facing the cylinder head and an open end fluidly connected to the first chamber wherein the tubular plunger is movable within the valve body;

a spring for urging the tubular plunger between a first position and a second position wherein the spring urges the tubular plunger into the first position when the piston approaches the cylinder base and into the second position when the piston approaches the cylinder head;

wherein when the tubular plunger is in the first position, openings formed in the tubular valve body allow fluid to drain from the second chamber through an outlet port and openings formed in the tubular plunger are covered by a portion of the interior wall of the tubular valve body; and wherein when the tubular plunger is in the second position, the valve body openings and the plunger openings are aligned whereby fluid is able to flow from the first chamber through the interior of the tubular plunger and through the aligned openings into the second chamber and the closed end of the plunger prevents fluid from flowing out from the second chamber through the outlet.

A method is also provided for operating a double-acting reciprocating motor comprising a movable piston disposed within a cylinder between a cylinder head and a cylinder base. The motor comprises a first variable volume chamber formed between the cylinder base and a first piston pressure surface, and a second variable volume chamber formed between the cylinder head and a second piston pressure surface. The second piston pressure surface is larger than the first piston pressure surface. A pass-through valve is operable to allow fluid to flow from the first chamber to the second chamber. An outlet valve is operable to drain fluid from the second chamber. The method of operating such a device comprises:

introducing the fluid through an inlet port into the first chamber to cause reciprocating motion of the piston;

closing the pass-through valve and opening the outlet valve when the piston approaches the cylinder base so that fluid pressure within the first chamber causes the piston to move towards the cylinder head while fluid is drained from the second chamber through the outlet valve;

opening the pass-through valve and closing the outlet valve when the piston approaches the cylinder head so that fluid pressure within the second chamber causes the piston to move towards the cylinder base.

In a preferred method the fluid employed for applying pressure to the piston is a liquid. The method preferably further comprises introducing the fluid through the inlet port that is formed in the cylinder base and draining the fluid through the outlet valve, which comprises an outlet port formed in the cylinder head. In such an arrangement the fluid enters one end of the motor and exits the motor from an opposite end. This is an advantage where it is desirable to simplify the flow path of the fluid and where it is desirable to reduce the heat transfer between the fluid and apparatus driven by the motor. For example, heat transfer is an important consideration when the motor is coupled to a cryogenic pump for driving a reciprocating pump piston.

Another advantage of the present motor is that it provides an arrangement that reduces the number of external connections and valves to operate the motor, compared to conventional differential piston double-acting reciprocating motors.

BRIEF DESCRIPTION OF THE DRAWINGS

Preferred embodiments of the invention and its operating modes are explained below with reference to the accompanying drawings, wherein.

DETAILED DESCRIPTION OF PREFERRED EMBODIMENT(S)

Figure 1:
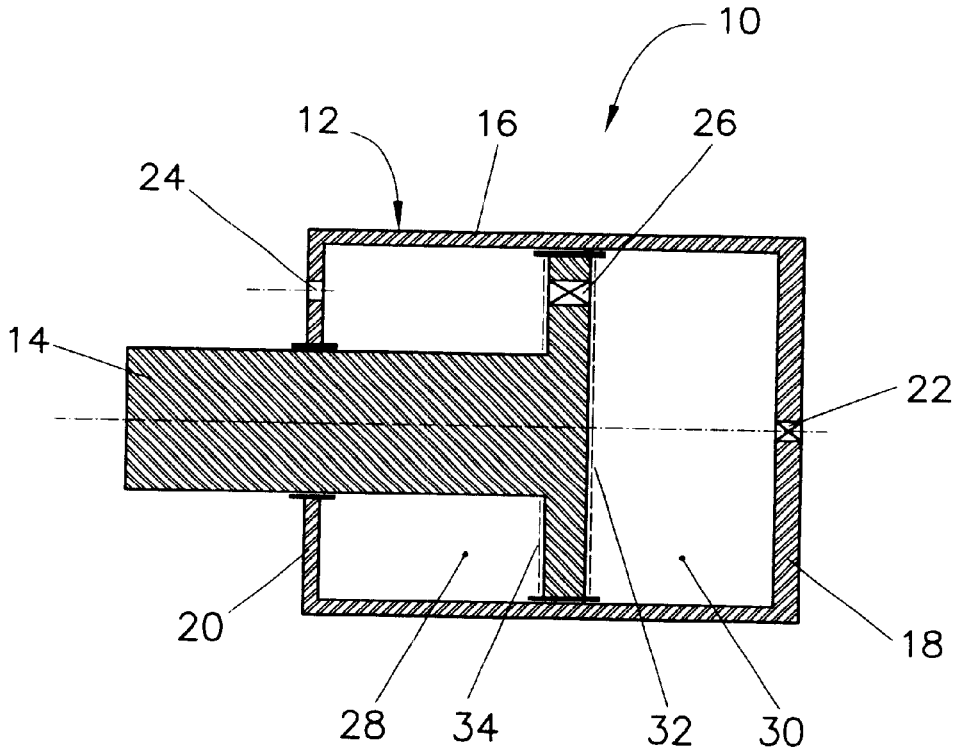
FIG. 1 is a schematic depiction of a cross section of an embodiment of a reciprocating motor with uni-directional fluid flow.

Referring now to the accompanying drawings, FIG. 1, depicts motor apparatus 10 which comprises cylinder assembly 12 which is fixed and designed to be stationary, and piston assembly 14 which comprises piston 16 that closely fits the inside diameter of cylinder assembly 12. Piston 16 separates the volume inside cylinder assembly 12 into two variable volume chambers.

Cylinder assembly 12 is bounded at one end by cylinder head 18 and at the opposite end by cylinder base 20. Outlet valve 22 is located in cylinder head 18 and inlet port 24 is provided in cylinder base 20. Piston 16 comprises pass-through valve 26 for controlling the flow of fluid from first chamber 28 to second chamber 30. The volume of first chamber 28 and second chamber 30 are variable since piston assembly 14 is movable so that piston 16 can travel between cylinder head 18 and cylinder base 20.

Piston 16 has an edge surface that fits closely against the interior walls of cylinder assembly 12. Piston 16 further comprises major pressure surface 32 that faces cylinder head 18 and has a larger area than minor pressure surface 34 that faces cylinder base 20. Minor pressure surface 34 has a smaller area because the piston shaft occupies part of its area.

Figure 2:
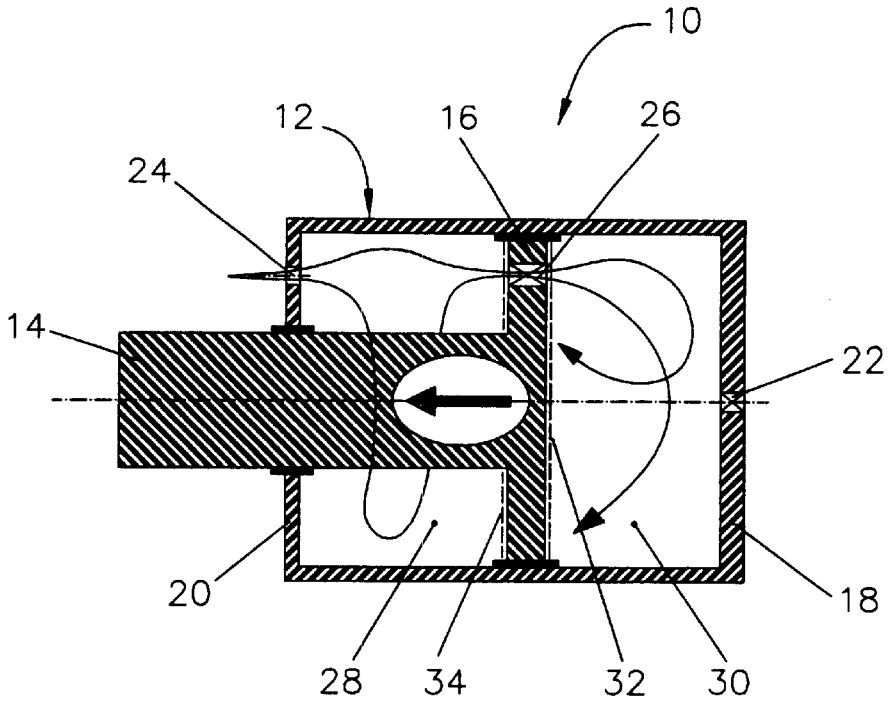
FIGS. 2 and 3 are schematic depictions of the reciprocating motor of FIG. 1 illustrating how fluid flows within the motor to cause reciprocal motion.
Figure 3:
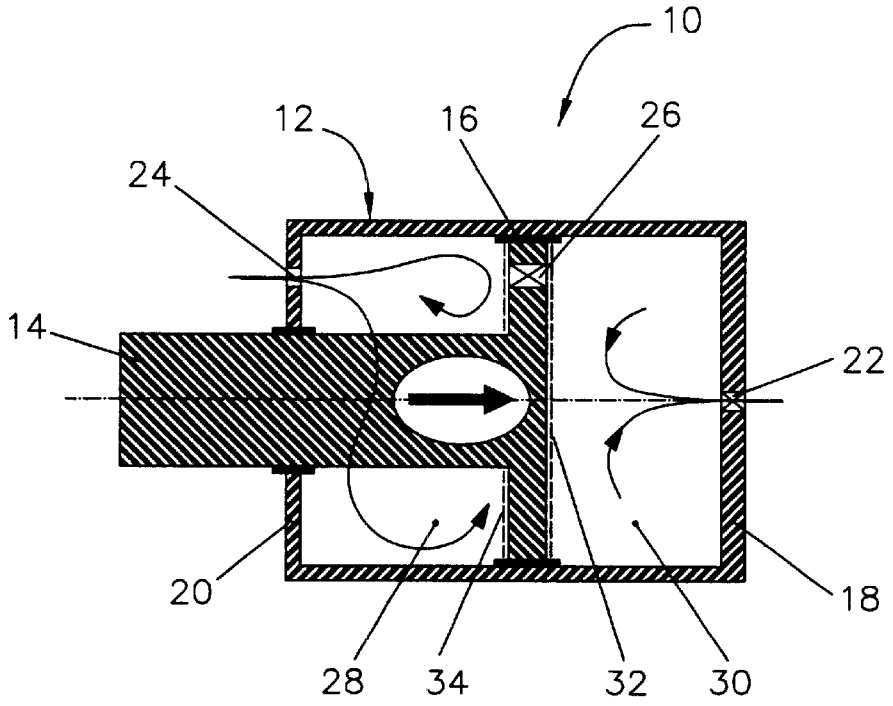

Having described the structural features associated with motor 10, the basic operation of this apparatus will be disclosed with reference to FIGS. 2 and 3. When motor 10 is in operation, pressurized fluid is supplied continuously and unobstructedly through inlet port 24. The fluid is thus initially introduced directly into first chamber 28. When piston 16 is moving towards cylinder base 20, as shown in FIG. 2, pass-through valve 26 is open and fluid flows from first chamber 28 into second chamber 30. Outlet valve 22 is closed. Since the area of major pressure surface 32 is larger than the area of minor pressure surface 34, a differential fluid pressure force is applied to piston 16, causing piston assembly 14 to move towards cylinder base 20. Piston assembly 14 continues to move in this direction until minor pressure surface 34 approaches cylinder base 20.

The movement of piston assembly 14 is reversed by closing pass-through valve 26 and opening outlet valve 22, as shown schematically in FIG. 3. Pressurized fluid continues to flow into first chamber 28, only now pass-through valve 26 is closed to confine newly introduced fluid to first chamber 28. The pressurized fluid acts upon minor pressure surface 34 to urge piston assembly 14 towards cylinder head 18. Fluid from the second chamber 30 is drained through open outlet valve 22 as piston assembly 14 advances towards cylinder head 18. When major pressure surface 32 approaches cylinder head 18, outlet valve 22 closes and pass-through valve 26 opens and the movement of piston assembly 14 reverses to begin the next cycle.

Reciprocating motor 10 thus operates as a double-acting motor, which employs fluid pressure and uni-directional fluid flow to move piston assembly 14 in reciprocal motion. The fluid drained through outlet valve 22 may be returned to a fluid reservoir (not shown) in a closed loop system.

With reference now to FIGS. 4–7, which depict a preferred physical arrangement, reciprocating motor 100 comprises cylinder assembly 112, piston assembly 114, piston 116, cylinder head 118, cylinder base 120, inlet port 124, first chamber 128, second chamber 130, major pressure surface 132 and minor pressure surface 134, which function in the same way as the similarly named components described with respect to FIGS. 1–3.

Figure 4:
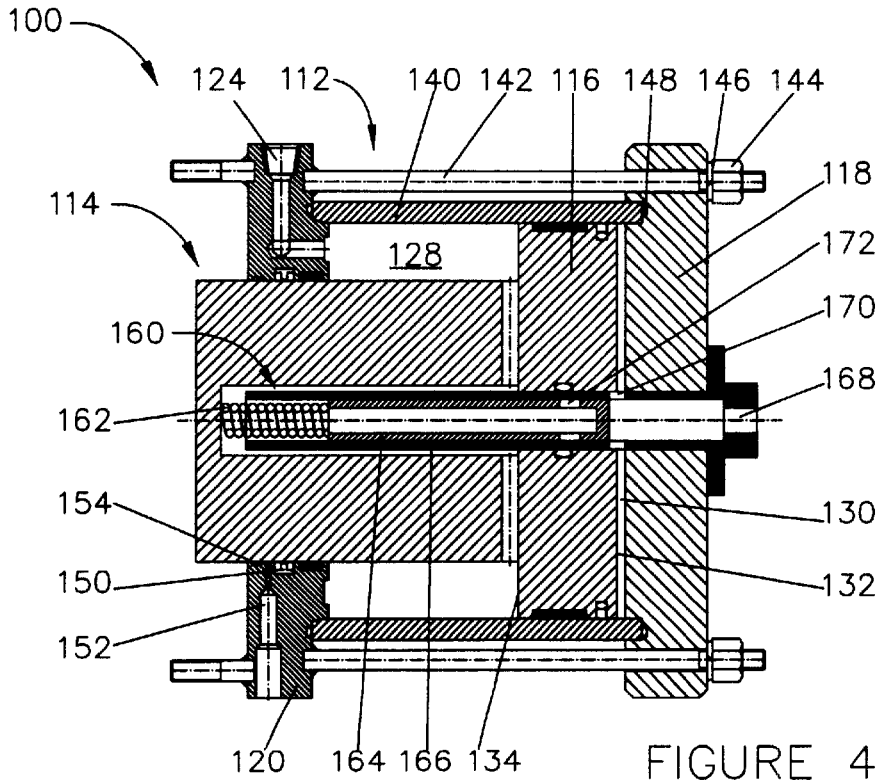
FIGS. 4–7 are sectional views showing a physical arrangement of a preferred embodiment of the reciprocating motor that show how the fluid flows through the motor at different stages of the motor cycle.

The construction of cylinder assembly 112 is typical of conventional reciprocating motors. A cylindrical body 140 with a cylindrical bore is disposed between two end plates, namely cylinder head 118 and cylinder base 120. Tie rods 142 are distributed around the periphery of cylinder assembly 112 and extend between cylinder base 120 and cylinder head 118 to hold cylinder assembly 112 together. Tie rods 142 may be welded to cylinder base 120, as shown in FIG. 4. Nuts 144 and spring lock washers 146 hold cylinder head 118 against cylindrical body 140. Static seals such as o-rings 148 help to provide sealing between cylindrical body 140 and the end plates. Cylinder base 120 comprises seals for sealing between a base opening and movable piston assembly 114 that extends therethrough. As shown in the illustrated embodiment, the seals may comprise a combination of sealing mechanisms such as interference fit seal 150 and O-ring seal 154. Vent 152 provides a means for detecting leakage through either seal 150 or O-ring 154.

FIGS. 4–7 illustrate sequential positions of piston assembly 114 that show how spring-loaded valve assembly 160 operates to control the uni-directional flow of fluid through motor 100.

Spring-loaded valve assembly 160 comprises spring 162, movable plunger 164, stationary valve body 166 (attached to cylinder head 118) and first and second releasable retainers (not shown) that hold plunger 164 in one of two discrete positions. Spring 162 is attached to plunger 164 and piston assembly 114 so that it can apply a spring force to plunger 164 when spring 162 is either compressed or stretched. When piston 116 approaches one of cylinder head 118 or cylinder base 120 the respective retainer is released and spring 162 causes plunger 164 to move from one position to the other position where it is held by the other retainer.

Figure 7:
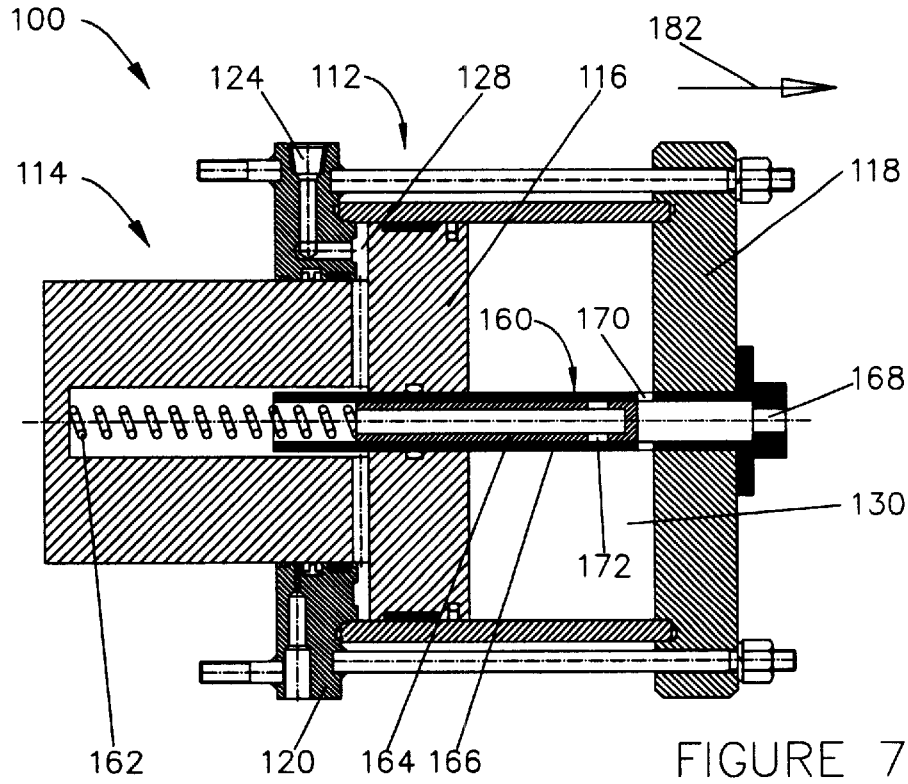

When plunger 164 is in the position shown in FIGS. 4 and 7, valve assembly 160 is configured in a "retraction" configuration. In the retraction configuration the flow of the fluid is controlled so that piston assembly 114 moves toward cylinder head 118. That is, when valve assembly 160 is in the retraction configuration, fluid pressure =causes piston assembly 114 to retract into the body of reciprocating motor 100. In the retraction configuration, the pressurized fluid entering through inlet port 124 is sealed inside first chamber 128 and the fluid within second chamber 130 flows out through valve outlet 168 via openings 170. Openings 170 are formed in valve body 166.

Figure 5:
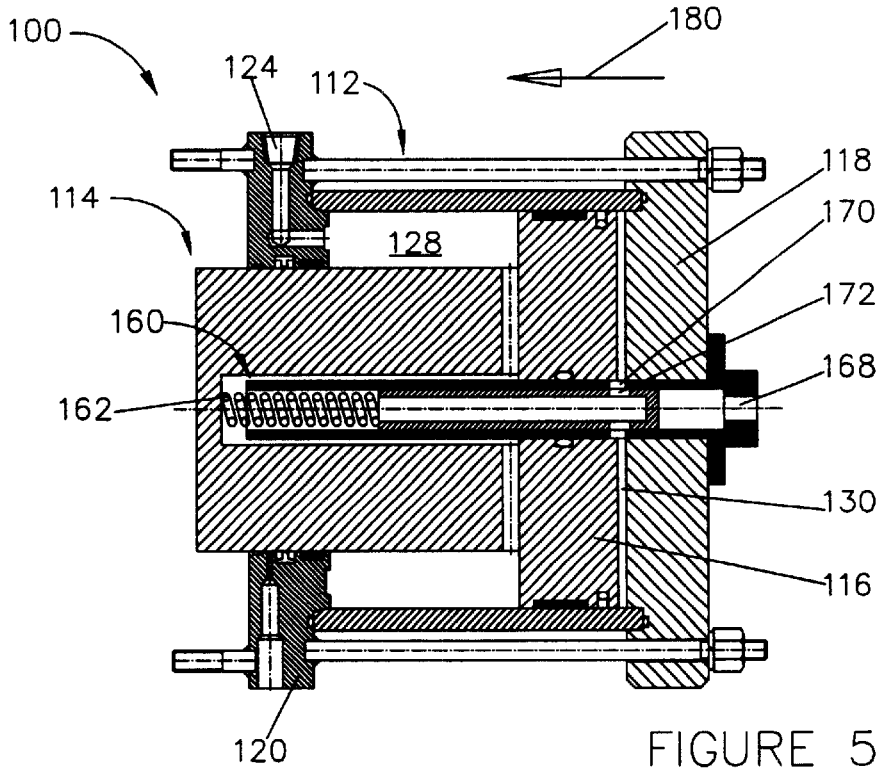
Figure 6:
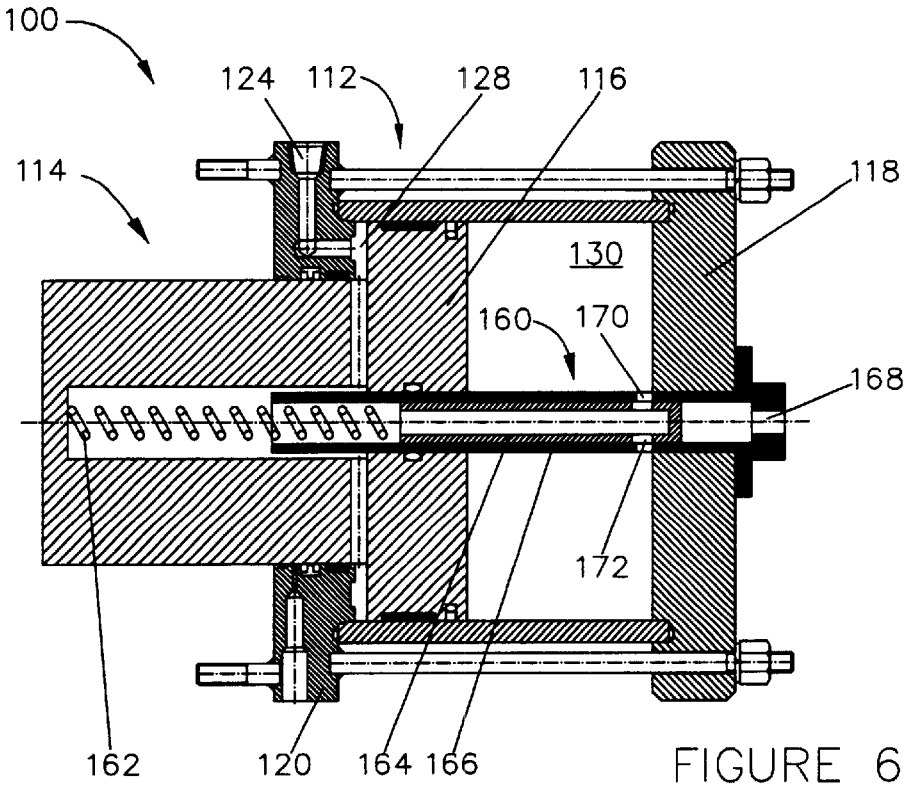

When plunger 164 is in the position shown in FIGS. 5 and 6, valve assembly 160 is configured in an extension configuration. In the extension configuration the flow of the fluid is controlled so that piston assembly 114 moves towards cylinder base 120. That is, when valve assembly 160 is in the extension configuration fluid pressure causes piston assembly 114 to extend from the body of reciprocating motor 100. When valve assembly 160 is in the extension configuration, openings 172, which are formed in plunger 164, are aligned with openings 170. The alignment of openings 170 and 172 allows pressurized fluid to flow through hollow plunger 164 and from first chamber 128 into second chamber 130. The closed end of plunger 164 prevents fluid from draining through valve outlet 168.

Referring now to FIGS. 4–7 in sequence. In FIG. 4, as described above, valve assembly 160 is in the retraction configuration which means piston assembly 114 is moving towards cylinder head 118 and plunger 164 is locked in the position shown in FIG. 4 by the first retainer. Substantially all of the fluid in second chamber 130 has drained through valve outlet 168 via openings 170. First chamber 128 is filled with high-pressure fluid and spring 162 is compressed. When piston assembly 114 approaches cylinder head 118, as shown in FIG. 4, the first retainer is released to allow the spring force and fluid pressure to urge plunger 164 so that it moves within valve body 166 towards valve outlet 168 to the position shown in FIG. 5.

FIG. 5 shows how plunger 164 has moved relative to valve body 166, from the position plunger 164 previously occupied that is depicted in FIG. 4. In FIG. 5, valve assembly 160 is in the extension configuration and openings 170 and 172 are aligned. Pressurized fluid in first chamber 128 can begin to flow through hollow plunger 164 into second chamber 130 to reverse the movement of piston assembly 114 so that it begins moving towards cylinder base 120. FIG. 5 shows how the movement of plunger 164 away from cylinder base 120 has resulted in the release of some of the spring force since, compared to FIG. 4, spring 162 is not as tightly compressed. The second retainer is engaged to lock valve assembly 160 in the extension configuration to prevent movement of plunger 164 during the extension stroke.

With valve assembly 160 in the extension configuration, piston assembly 114 of FIG. 5 moves in the direction of arrow 180 until it approaches cylinder base 120, as shown in FIG. 6. In FIG. 6, valve assembly 160 is still locked in the extension configuration by the second retainer, but when piston assembly 114 approaches cylinder base 120, the second retainer is released, allowing spring 162 to pull plunger 164 into the position shown in FIG. 7.

In FIG. 7, valve assembly 160 is returned to the retraction configuration and the first retainer is once again engaged to lock plunger 164 in the shown position. In the retraction configuration fluid escapes from second chamber 130 through openings 170, while pressurized fluid introduced into first chamber 128 through inlet port 124 acts on piston 116 to urge piston assembly 114 towards cylinder head 118 (in the direction of arrow 182). Piston assembly 114 continues to travel in this direction until it approaches cylinder head 118 as shown in FIG. 4. The cycle repeats as long as the motor is operated and fluid is introduced through inlet port 124.

An advantage of the embodiment of FIGS. 4–7 is that because valve assembly 160 integrates the pass-through valve and the outlet valve, it functions to switch the position of valve openings 170 and 172 simultaneously. Consequently, when valve assembly 160 switches to the extension position (FIG. 5) the pass-through passage is opened concurrently with the closing of the outlet passage. Similarly, when valve assembly 160 switches to the retraction position (FIG. 7), the fluid path to valve outlet 168 is opened concurrently with the closing of the pass-through fluid passage. This arrangement obviates the need to ensure simultaneous operation of separate pass-through and outlet valves.

Figure 8:
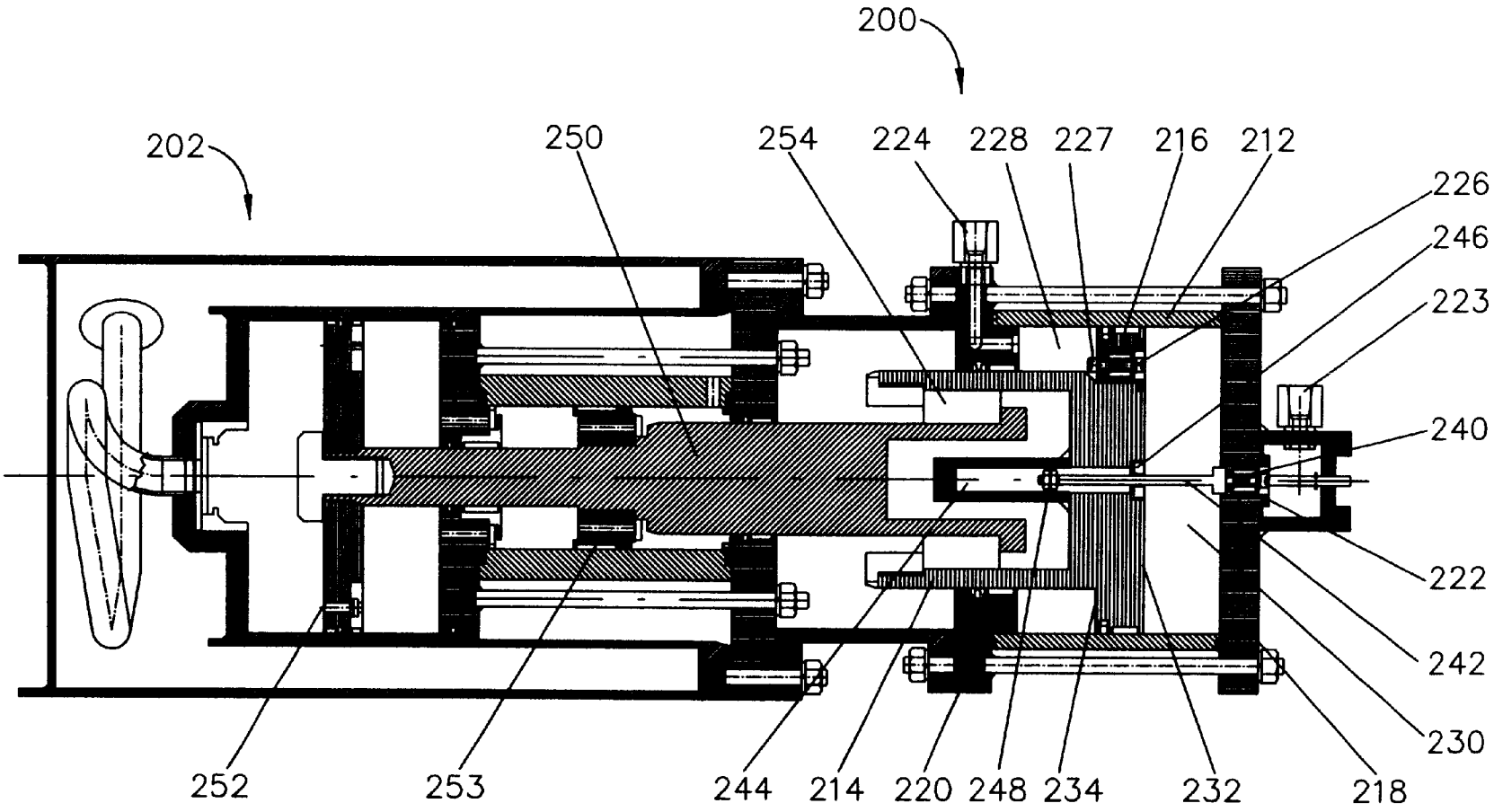
FIG. 8 is a sectional view of an embodiment of the reciprocating motor coupled to a cryogenic reciprocating pump for driving a double-acting pump piston.

FIG. 8 illustrates an example of one of the many advantageous applications for the present device. In FIG. 8, reciprocating motor 200 is shown coupled to cryogenic pump 202. A cryogenic pump developed by Gram et al. and described in U.S. Pat. No. 5,884,488 is incorporated herein by reference into the present specification. Such a pump is suitable, for example, for pumping liquid natural gas (LNG).

Reciprocating motor 200 comprises cylinder assembly 212, piston assembly 214, piston 216, cylinder head 218, cylinder base 220, outlet valve 222, inlet port 224, pass-through valve 226, first chamber 228, second chamber 230, major pressure surface 232 and minor pressure surface 234, which function in the same way as the similarly named components described with respect reciprocating motor 10 shown in FIGS. 1–3. Reciprocating motor 200 further comprises many components that are similar to the components of reciprocating motor 100 of FIGS. 4–7, and for the sake of brevity these components will not be described again with respect to reciprocating motor 200.

Reciprocating motor 200 shows another embodiment of a valve arrangement for controlling the uni-directional flow of fluid from inlet port 224 to outlet port 223. In FIG. 8, reciprocating motor 200 is shown with the valves in position for extending piston assembly 214 from cylinder assembly 212 (that is, towards cylinder base 220 and cryogenic pump 202). Pass-through valve 226 is in the open position, allowing fluid to flow from first chamber 228 to second chamber 230. Outlet valve 222 is in the closed position, allowing fluid pressure to build in second chamber 230 to provide the differential fluid pressure force for the extension stroke. When piston 216 approaches cylinder base 220, the positions of the valves reverse so that pass-through valve 226 is closed and outlet valve 222 is open. Accordingly, reciprocating motor 200 operates in a manner similar to the other embodiments in that it employs a uni-directional fluid flow path with only two valve mechanisms.

Outlet valve 222 comprises plunger 240 that cooperates with a seat provided in cylinder head 218 when outlet valve 222 is in the closed position, as shown in FIG. 8. Stem 242 extends from plunger 240 into well 244 formed in piston assembly 214. When piston 216 approaches cylinder base 220, actuator plate 246 acts upon stem head 248 to switch outlet valve 222 into the open position by pulling plunger 240 away from the valve seat. When piston 216 is moving in the opposite direction, as it approaches cylinder head 218, the bottom of well 244 acts upon stem head 248 and closes outlet valve 222 by urging plunger 240 against the valve seat. In the alternative, the closing force may be applied by a portion of major pressure surface 232 that bears against a surface of stem 242 or plunger 240.

Pass-through valve 226 comprises plunger 227 that extends through a bore formed within the body of pass-through valve 226. Plunger 227 reciprocates within the bore to switch pass-through valve 226 from an open position to a closed position. In the embodiment shown in FIG. 8, plunger 227 extends from at least one of the surfaces of piston 216. In FIG. 8, pass-through valve 226 is in the open position and when piston 216 approaches cylinder base 220, the extended end of plunger 227 contacts cylinder base 220 and is urged into the body of pass-through valve 226 to switch pass-through valve 226 into the closed position. When pass-through valve 226 is in the closed position, fluid pressure in first chamber 228 builds to force piston assembly 214 to move towards cylinder head 218. In this part of the cycle (the retraction stroke) plunger 227 extends from major pressure surface 230 so that the extended end of plunger 227 contacts cylinder head 218 when piston 216 approaches cylinder head 218 at the end of the retraction stroke. Pass-through valve 226 is preferably spring-loaded with releasable retainers for locking the valve in the open or closed position. In the preferred embodiment, contact between plunger 227 and one of the end plates releases a first releasable retainer and switches the valve to the other position where it is locked in that position by a second releasable retainer.

Reciprocating shaft 250 extends between reciprocating motor 200 and cryogenic pump 202. Shaft 250 transmits the driving force from reciprocating motor 200 to pump pistons 252 and 253. Shaft 250 is attached to piston assembly 214 by insulated coupling 254, and the uni-directional fluid flow path through motor 200 helps to reduce the effects of heat transfer between cryogenic pump 202 and the fluid.

The present apparatus and method provide particular advantages for cryogenic applications, where the uni-directional fluid flow path reduces the effect of heat transfer between the cryogenic apparatus and the fluid within the reciprocating motor. However, the device may also be used for other applications that may benefit from the simple two-valve control of the fluid flow within the motor and the reduced number of connections and associated piping associated with conventional differential pressure reciprocating motors. Accordingly, the description is intended to be illustrative and not limiting.

With respect to the apparatus itself, while particular elements and embodiments of the present invention have been shown and described, it will be understood, of course, that the invention is not limited thereto since modifications may be made by those skilled in the art without departing from the scope of the present disclosure, particularly in light of the foregoing teachings.

What is claimed is:

1. A double-acting reciprocating motor with a uni-directional flow path, said motor comprising:

a housing having a hollow cylinder disposed between a cylinder head and a cylinder base, a piston disposed within said cylinder between said cylinder head and cylinder base, said piston having a first pressure surface area and a second pressure surface area opposite to and larger than said first pressure surface area, a piston rod operatively associated with said piston and extending from said piston through said cylinder base, fluid inlet for directing uni-directional fluid flow to a first chamber within said cylinder associated with said first surface area, a fluid outlet for draining fluid from a second chamber within said cylinder associated with said second surface area, a fluid passageway disposed within said piston, said fluid passageway fluidly connecting said first chamber to said second chamber, a pass-through valve for selectively opening and closing said fluid passageway, and an outlet valve that is openable for draining fluid from said outlet when said pass-through valve is in the closed position.

2. The reciprocating motor of claim 1 wherein said fluid is a liquid.

3. The reciprocating motor of claim 1 wherein said reciprocating motor is for driving a double-acting cryogenic pump.

4. The reciprocating motor of claim 1 wherein said pass-through valve comprises a movable plunger disposed within a bore formed in the body of said pass-through valve, wherein:

said bore has a longitudinal axis that is parallel to the longitudinal axis of said cylinder;

said plunger is movable to reciprocate within said bore; and said pass-through valve is actuated to switch between open and closed positions by an end of said plunger contacting a surface of said housing when said piston approaches one of said cylinder base and said cylinder head.

5. The reciprocating motor of claim 1 wherein said outlet valve comprises:

a plunger movable within a bore provided in said outlet valve, said plunger having a sealing surface that may be pressed against a valve seat to close said outlet valve and lifted away from said seat to open said outlet valve.

6. The reciprocating motor of claim 5 further comprising a valve stem attached to said plunger for actuating said outlet valve wherein said outlet valve is automatically actuated by contact between said piston and said valve stem when said piston approaches one of said cylinder head and said cylinder base.

7. The reciprocating motor of claim 6 wherein one end of said valve stem is disposed within a well formed within said piston and said piston further comprises an actuating plate that contacts an enlarged end portion of said valve stem to lift said plunger from said valve seat when said piston approaches said cylinder base.

8. The reciprocating motor of claim 7 wherein said plunger sealing surface is urged against said valve seat by said piston contacting said valve stem or said plunger when said piston approaches said cylinder head.

9. The reciprocating motor of claim 7 wherein said plunger sealing surface is urged against said valve seat by the bottom of said well contacting said one end of said valve stem when said piston approaches said cylinder head.

10. The reciprocating motor of claim 1 wherein said pass-through valve and said outlet valve are combined in an integrated valve assembly.

11. The reciprocating motor of claim 10 wherein said integrated valve assembly comprises:

a tubular valve body associated in fixed relationship with said cylinder head;

a tubular plunger disposed within said tubular valve body with a closed end facing, said cylinder head and an open end fluidly connected to said first chamber wherein said tubular plunger is movable within said valve body;

a spring for urging said tubular plunger between a first position and a second position wherein said spring urges said tubular plunger into said first position when said piston approaches said cylinder base and into said second position when said piston approaches said cylinder head;

wherein when said tubular plunger is in said first position, openings formed in said tubular valve body allow fluid to drain from said second chamber through an outlet port and openings formed in said tubular plunger are covered by a portion of the interior wall of said tubular valve body; and wherein when said tubular plunger is in said second position, said valve body openings and said plunger openings are aligned whereby fluid is able to flow from said first chamber through the interior of said tubular plunger and through said aligned openings into said second chamber and said closed end of said plunger prevents fluid from flowing out from said second chamber through said outlet.

12. A method of operating a double-acting reciprocating motor with a uni-directional flow path, the motor comprising a movable piston disposed within a cylinder between a cylinder head and a cylinder base with a first variable volume chamber formed between said cylinder base and a first piston pressure surface and a second variable volume chamber formed between said cylinder head and a second piston pressure surface, wherein said second piston pressure surface is larger than said first piston pressure surface, a pass-through valve is operable to allow fluid to flow from said first chamber to said second chamber, and an outlet valve is operable to drain fluid from said second chamber, said method comprising:

introducing the fluid through an inlet port into said first chamber to cause reciprocating motion of said piston;

closing said pass-through valve and opening said outlet valve when said piston approaches said cylinder base so that fluid pressure within said first chamber causes said piston to move towards said cylinder head while fluid is drained from said second chamber through said outlet valve;

opening said pass-through valve and closing said outlet valve when said piston approaches said cylinder head so that fluid pressure within said second chamber causes said piston to move towards said cylinder base.

13. The method of claim 12 wherein the fluid is a liquid.

14. The method of claim 12 wherein said inlet port is formed in said cylinder base and said outlet valve comprises an outlet port formed in said cylinder head so that said fluid enters one end of said motor and exits said motor from an opposite end.

15. The method of claim 14 wherein said motor is coupled to a cryogenic pump for driving a reciprocating pump piston.

* * * * *